US007395632B2

(12) United States Patent
Filippi

(10) Patent No.: US 7,395,632 B2
(45) Date of Patent: Jul. 8, 2008

(54) GUTTER-COVER SYSTEM

(75) Inventor: David G. Filippi, Chesterfield, VA (US)

(73) Assignee: Elko Products Company, Inc., Midlothian, VA (US)

( * ) Notice: Subject to any disclaimer, the term of this patent is extended or adjusted under 35 U.S.C. 154(b) by 362 days.

(21) Appl. No.: 10/798,779

(22) Filed: Mar. 12, 2004

(65) Prior Publication Data

US 2005/0011136 A1 Jan. 20, 2005

Related U.S. Application Data

(60) Provisional application No. 60/453,952, filed on Mar. 13, 2003.

(51) Int. Cl.
*E04D 13/068* (2006.01)
*A44B 21/00* (2006.01)

(52) U.S. Cl. ..... 52/12; 52/712; 24/545

(58) Field of Classification Search ..... 52/11, 52/12, 16, 13–15, 712; 248/48.1, 48.2; 24/289, 24/293, 297, 545, 462, 563
See application file for complete search history.

(56) References Cited

U.S. PATENT DOCUMENTS

| | | | | |
|---|---|---|---|---|
| 4,455,791 | A * | 6/1984 | Elko et al. | 52/12 |
| 5,426,832 | A * | 6/1995 | Doussot et al. | 24/543 |
| 6,347,780 | B1 * | 2/2002 | Holbrook | 248/544 |
| 6,735,907 | B2 * | 5/2004 | Stevens | 52/12 |
| 2002/0069594 | A1 * | 6/2002 | Sweet | 52/12 |

* cited by examiner

*Primary Examiner*—Robert Canfield
*Assistant Examiner*—Christine T Cajilig
(74) *Attorney, Agent, or Firm*—Thomas & Raring, P.C.

(57) ABSTRACT

An improved gutter-cover system has a clip which includes movable jaws and a locking lever for locking a given clip in place on a variety of gutter types.

35 Claims, 6 Drawing Sheets

GUTTER-COVER SYSTEM

RELATED APPLICATIONS

This application claims the benefit of the filing date of U.S. Provisional Application Ser. No. 60/453,952 filed Mar. 13, 2003.

BACKGROUND

This invention relates to a gutter cover system having an improved clip for spacing a gutter cover from the outer edge of the gutter to maintain a desired small space between the gutter cover and the outer wall of the gutter.

PRIOR ART

More specifically, this invention relates to such a system having an improved clip of the type illustrated in FIG. 7 of U.S. Pat. No. 4,455,791. In that patent, a gutter cover has a curled edge that is spaced by a clip from the outer wall of the gutter so that surface tension causes water to follow the curl and cascade into the gutter.

OBJECTS AND SUMMARY

Clips of the type illustrated in FIG. 7 of the '791 patent tend to become twisted and/or dislodged so that the spacing between the gutter cover's curl and the outer wall of the gutter becomes disrupted and water does not flow into the gutter as desired.

It is an object of this invention to provide a system having an improved clip that does not tend to become dislodged thereby maintaining the desired spacing between the gutter cover's curl and the outer wall of the gutter.

It is another object of this invention to provide a system having a gutter-cover clip for gutters that do not have inwardly turned lips such as those illustrated in FIG. 7 of the '791 patent.

It is another object of the invention to provide such a system having a gutter-cover clip that does not require screws or the like to hold it in place.

The system of the invention includes a clip which spaces the outer wall of the gutter from the gutter covers curl and includes, as a portion thereof, an improved means for affixing the clip to the gutter. In this respect, the affixing member is removably affixable so that the location and placement of the clip may be changed if desired. Moreover, the affixing member is adapted to accommodate gutter walls having a variety of shapes and thicknesses.

DETAILED DESCRIPTION

Figure 1:
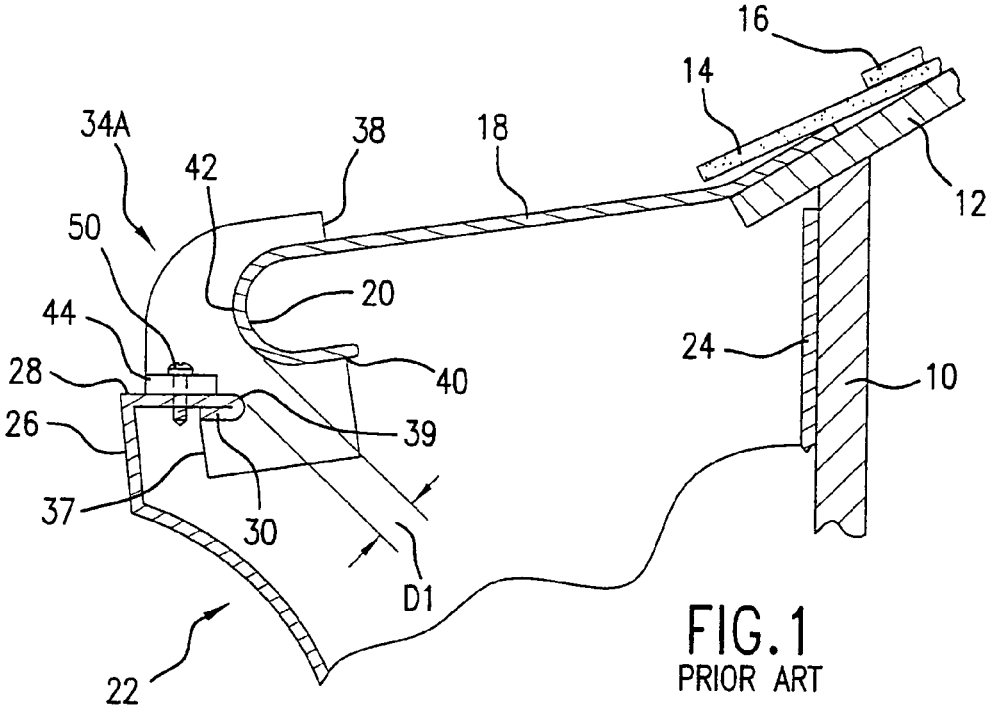
FIG.1 PRIOR ART
FIG. 1 is a side schematic side view of a prior-art clip affixed to a typical gutter as typically mounted to facia under a house roof.

FIG. 1 illustrates a typical fascia or cornice 10 under typical house roofing 12 covered by one or more courses of shingles 14 and 16. A gutter cover 18 is one of the types shown in U.S. Pat. No. 4,455,791 having a curled portion 20 at the outer end thereof.

A typical gutter 22 has a vertical back wall 24 thereof which abuts the fascia 10. A front wall 26 has a generally horizontal portion 28 at the upper end ending, if desired, in an inwardly turned lip 30.

Figure 2:
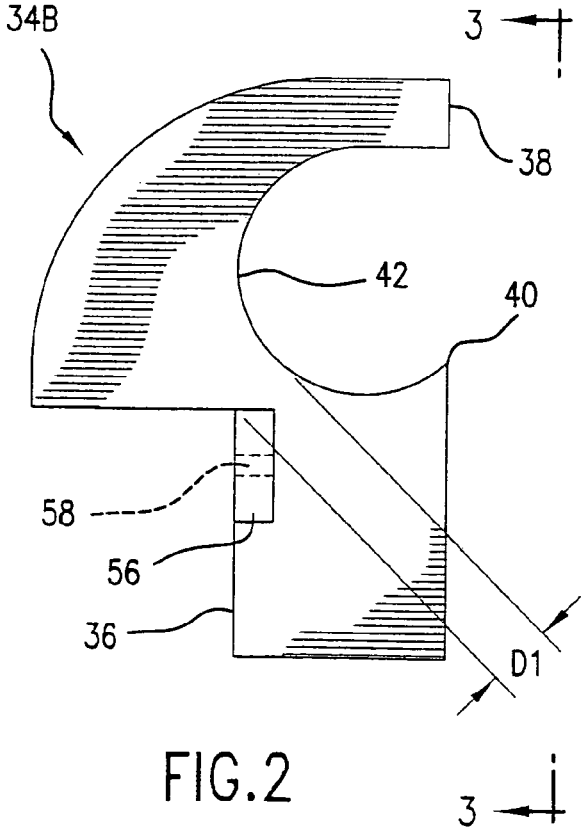
FIG. 2 is a side view of a clip for mounting on a vertical face of a gutter that does not have a more-conventional, inwardly turned lip to which a gutter-cover clip would otherwise attach.

A clip 34A spaces the gutter cover 18 from the lip 30 of the gutter 22 to maintain a relatively critical curl-to-gutter distance D1 in FIG. 2 of between about 1/8 inch (3.2 mm) and 5/16 inch (8 mm) but preferably about 5/21 inch (4 mm). This spacing permits water resulting from even a downpour to follow the curl 20 of the gutter cover so that the water from the roof cascades into the gutter. The clip 34A includes an apertured horizontal tab 44 for use with a self-tapping screw 50 to affix the clip 34A to the inwardly turned lip 30. In this respect, it has been known in the art to use such a horizontal tab to affix gutter clips to horizontal gutter portions such as 28 in FIG. 1.

The FIG. 1 clip 34A has an outwardly extending lower portion 37 located under the inwardly turned lip 30 to maintain the spacing between the curl 20 and the inwardly turned lip as determined by the curl-to-gutter distance D1.

The clip 34B (FIG. 2) also has an upper jaw 38 and a lower jaw 40 on either side of a throat 42, which is shaped to accommodate the curl 20 of the gutter cover 18. In this embodiment an outwardly extending lower portion 37 of the FIG. 1 embodiment is eliminated and a vertical stop portion 36 abuts the gutter [either the portion 30 in FIG. 1 or a plain vertical wall 54 (FIG. 4)] at 39 to maintain the spacing D1 between the curl 20 and the gutter. In this respect, the stop-to-throat distance from point 39 on stop 36 to the throat 42 is essentially the same as the curl-to-gutter distance D1. A generally vertical tab 56 in FIG. 2 has an aperture 58 therein to accommodate a fastener such as a self-tapping screw 60 in FIG. 4 for affixing the clip 34B to a gutter 52 made out of a material such as vinyl and having a simple vertical front wall 54. In that embodiment, the vertical stop portion 36 and the vertical tab 56 abut the vertically oriented front wall 54 of the gutter 52 and the stop-to-throat distance is D1 as shown.

The thickness (D in FIG. 3) of the clips 34A, 34B, 34C, 34D and 34E of the drawings is between about 0.09 inches (about 2.3 mm) and 0.250 inches (about 6.4 mm). The preferred thickness is about 0.10 inch (about 7/64 inch—2.5 mm). The thickness D, however, is not as significant in the structures of FIGS. 1-4 as in the screwless-clamp embodiments about to be described.

The materials from which the FIGS. 1-4 embodiments are fabricated range from plastic to metals such as aluminum, steel, or the like.

Figure 4:
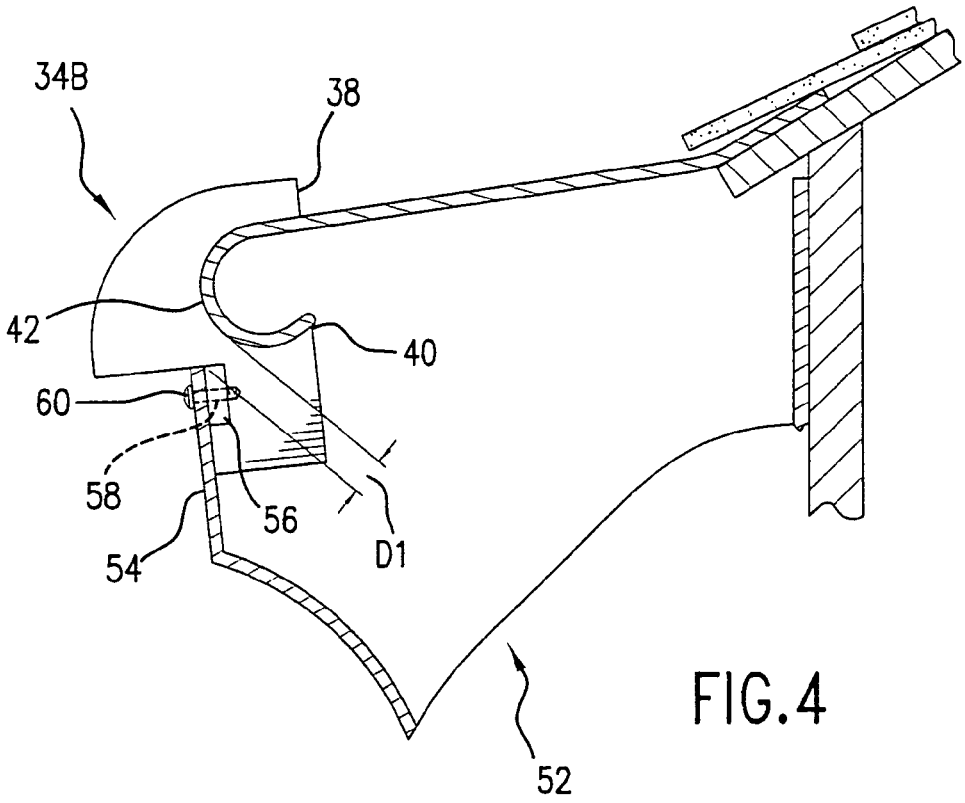
FIG. 4 is a schematic view of the clip of FIGS. 2 and 3 mounted on a gutter's vertical face.
Figure 5:
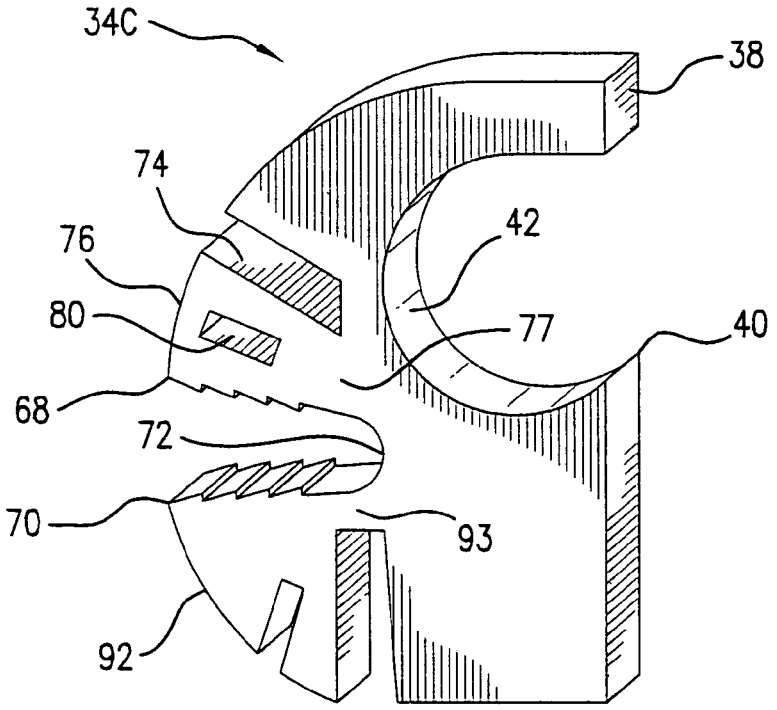
FIG. 5 is a schematic, pictorial view of a clip which includes screwless locking levers of the invention.

The clips 34C and 34D of the FIGS. 5-11 embodiments are suited for use with both the conventional gutter having an inwardly turned lip portion 30 as shown in FIG. 1 and the vertical wall portion 54 of the typically vinyl gutter of the FIG. 4 embodiment—or either one. These later clips are best made out of materials such as aluminum or steel that will bend to a set position.

Clips 34C, 34D, and 34E of FIGS. 5-12 provide a first planar side and a second planar side with an outer edge. The clip therefore resides in a single plane with the substantially flat, planar body of clips 34C, 34D, and 34E being of the thickness provided above.

Figure 7:
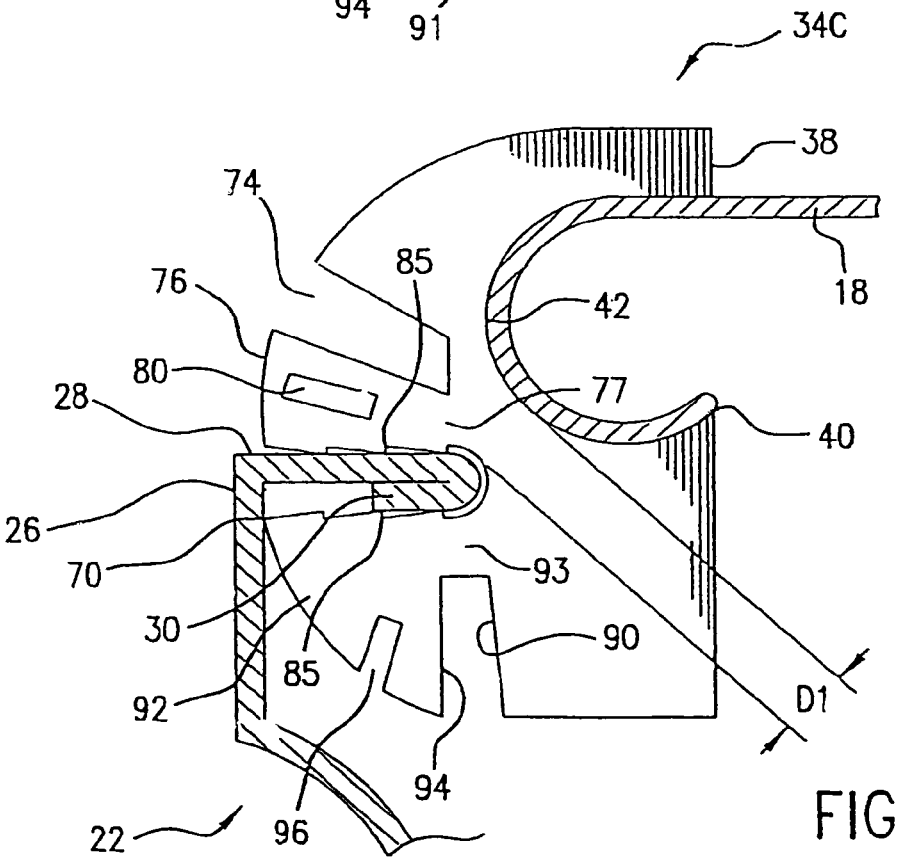
FIG. 7 corresponds to FIG. 6, but illustrates a clip of the invention having a locking lever in a locked position.
Figure 8:
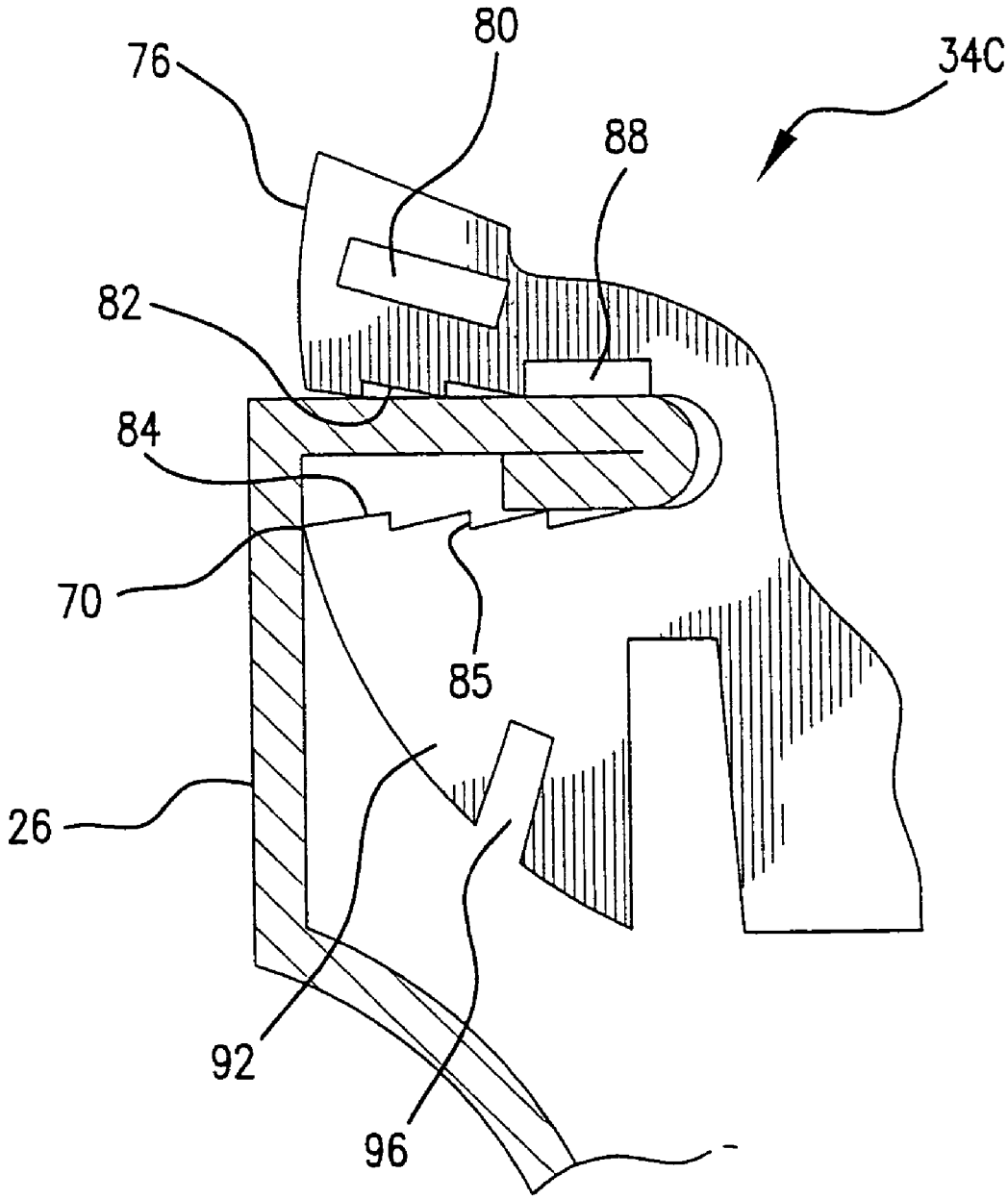
FIG. 8 is a fragmentary portion of the FIG. 7 clip, but includes an additional recess in one of the jaws of a locking lever.

The clip 34C (FIG. 5) includes additional jaws 68 and 70 and a throat 72 for accommodating the inwardly turned lip portion 30 of a conventional gutter such as 22 in FIGS. 7 and 8. Additionally, a bending slot 74 is cut into the upper portion of the clip 34C to form a locking lever 76, hinged at 77 between the jaw 68 and the bending slot 74.

Upon insertion of the clip 34C between the lip 30 and the gutter cover 18 as shown in FIG. 7, the locking lever 76 is bent downwardly about hinge 77 by a screwdriver or the like as shown in FIG. 7 to lock the clip 34C to the gutter so that the jaws 68 and 76 engage the lip 30. In this respect, it will be noted that the bending slot 74 widens as the locking lever 76 is moved downwardly.

If desired, the locking lever 76 can include a supplemental locking slot or indentation 80 for accommodating the blade of a screwdriver which can be used to move the locking lever 76 upwardly or downwardly into the locked position shown in FIG. 7.

Figure 6:
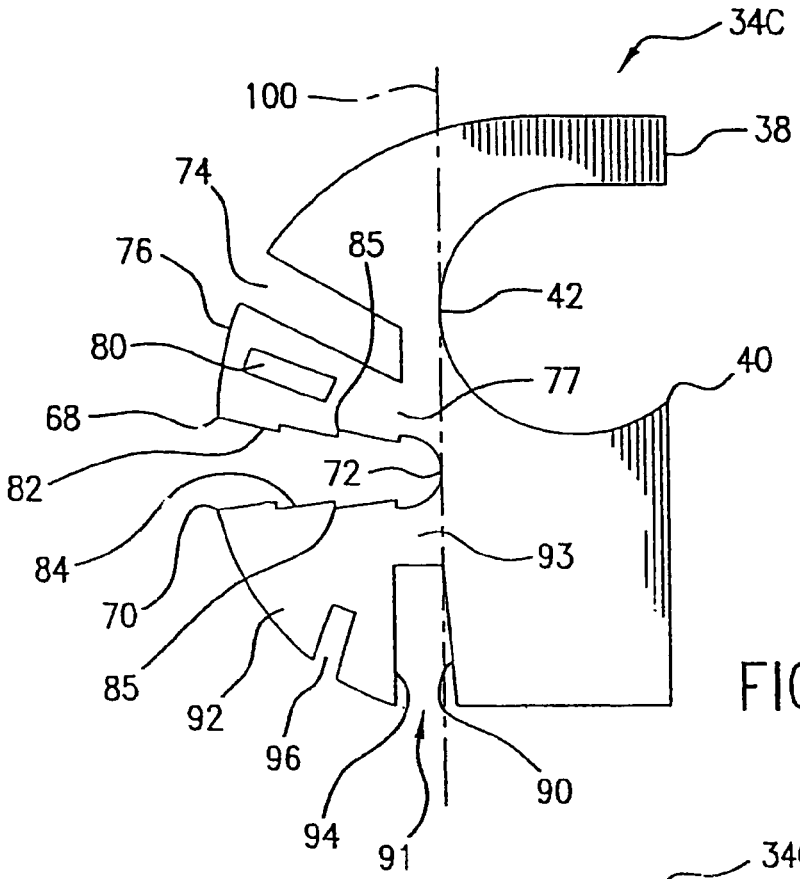
FIG. 6 is a side view of a FIG. 5-*type* clip in an unlocked position.

If desired, the jaw walls 82 and 84 in FIG. 6 can include serrations 85 as shown to assist in holding the walls 82 and 84 against the lip 30. The serrations are slanted so that the serration teeth bite into the horizontal portion 28 and the lip 30 to restrict outward movement of the gutter out of the throat 72 of the clip.

As shown in FIG. 8, the jaw wall 82 of the locking lever 76 can include a recessed unlocking portion 88 for accommodating an instrument such as a screwdriver blade. In this manner, the instrument can be inserted into the recess 88 (or slat 80) and rotated in a clockwise direction to move the jaw walls 82 and 84 away from each other if it is desired to remove or relocate the clip 34C.

If desired, the clip 34C can either alternatively or additionally include a vertical slot having a throat 91 and walls 90 and 94 (FIG. 6) in the lower portion of the clip 34C to engage the vertical wall 54 of the gutter type illustrated in FIG. 4. This forms a second or alternative locking lever 92 hinged at 93 and having a wall 94 of the slot 90 movable into engagement with the vertical wall 54 by counterclockwise rotation of the second locking lever 92 such as by insertion of an instrument such as a screwdriver into a second or alternative bending slot 96 and then rotating the instrument in a counterclockwise direction. If desired, the walls 90 and 94 can include serrations corresponding to serrations 85 on the walls 82 and 84.

Figure 9:
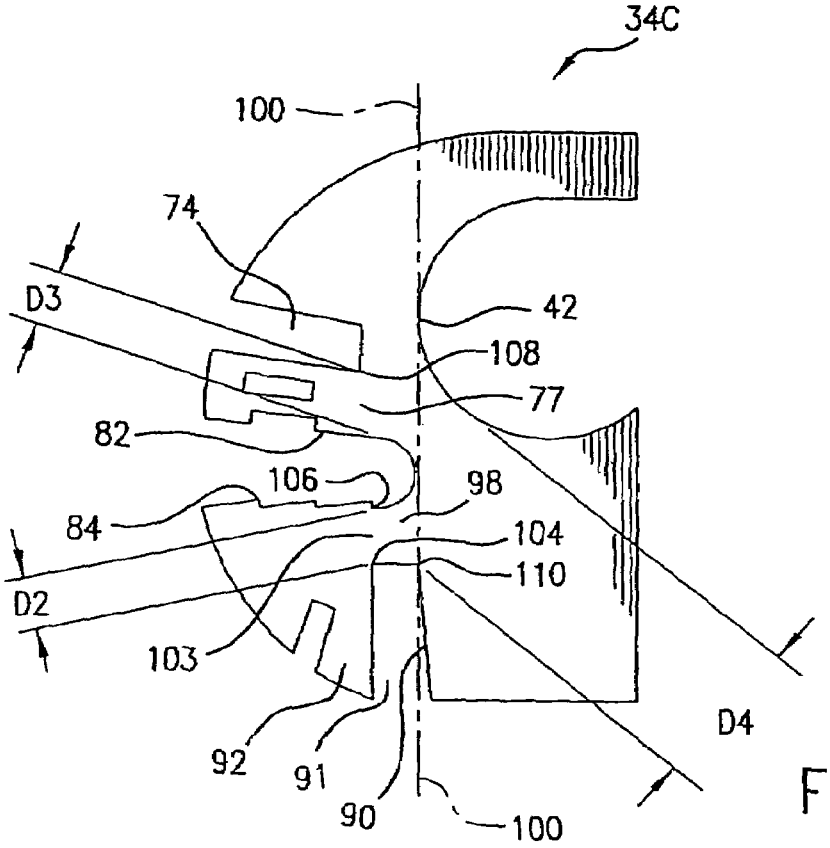
FIG. 9 is a side view of a FIG. 5-*type* clip illustrating certain significant parameters thereof.

Although quite asymmetrical, the clip 34C is preferably constructed about a vertical axis 100 in FIGS. 6 and 9. That is, the left-most or deepest portion of the throat 42 in FIGS. 6 and 9 is in vertical alignment with the right-most walls 90 of the slot 91.

As shown in FIG. 9 the shortest distance D2 between point 106 on the wall 84 and the deepest penetration 104 of the slot 91 is the thickness of the hinge 93 for the locking lever 92.

Figure 3:
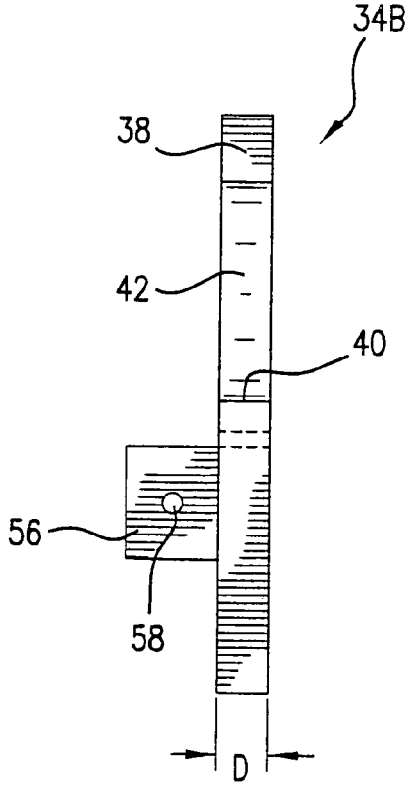
FIG. 3 is an end view of the clip of FIG. 2 taken along the lines 3-3 thereof.

D2 is preferably between about 1/16 inch and 5/32 inch and most preferably about 3/32 inch. Similarly, the shortest distance D3 between the lower-most deepest corner 108 of the slot 74 and the wall 82 is the thickness of hinge 77 for the locking lever 76. The hinge thickness D3 is preferably between about 1/16 inch and 7/64 inch but most preferably about 3/32 inch. As the thickness D of the clip (as shown in FIG. 3, for example) increases, the thickness of the hinges D2 and D3 should decrease proportionately. The ratios of D2 to D and D3 to D, however, are preferably between about 0.25 and 1.2; and most preferably about 0.94.

The shortest curl-to-gutter (stop-to-throat) distance D4 between the portion of the throat 42 adjacent the curled portion 20 of the gutter cover 18 and stop-corner 110 of slot 90 in FIG. 9 should be between about 1/8 inch and 7/16 inch, but most preferably about 5/16 inch.

Figure 10:
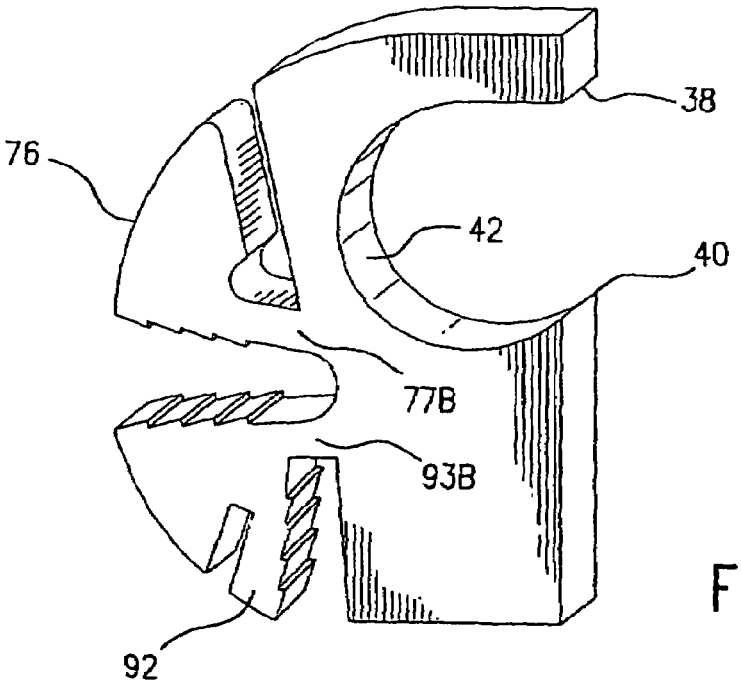
FIG. 10 is a schematic, pictorial view of an alternative embodiment of the FIG. 5 clip.
Figure 11:
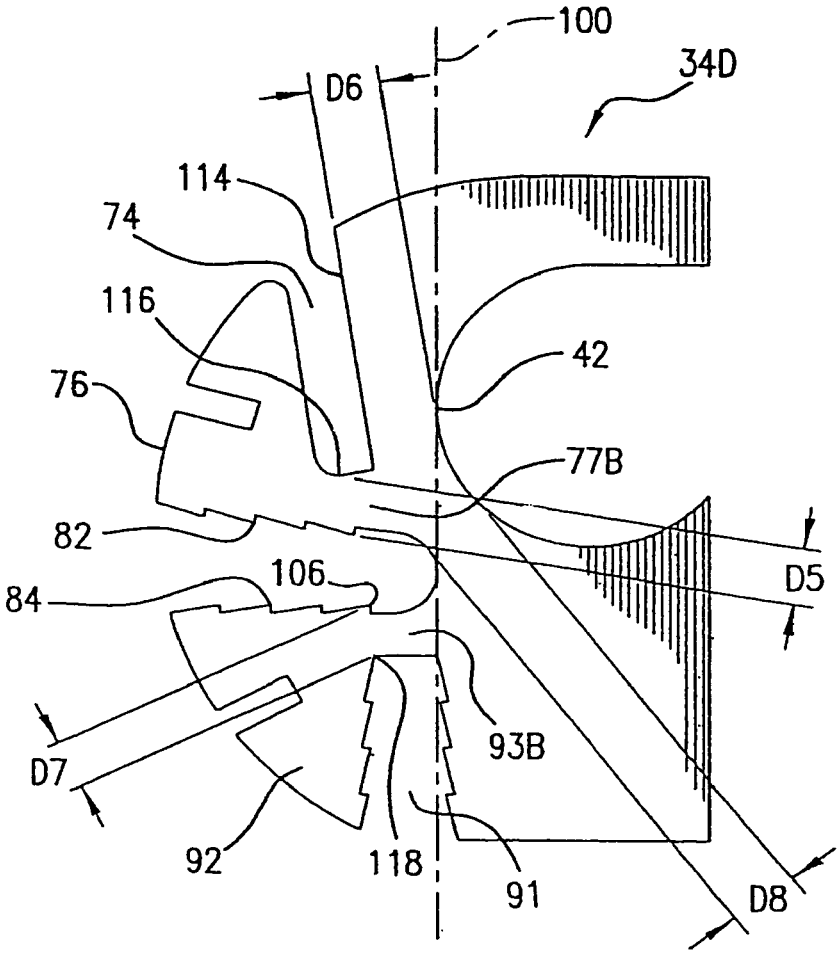
FIG. 11 is a side view of the clip of FIG. 10 illustrating a critical ratio of certain portions of the structure of FIGS. 10 and 11.
Figure 12:
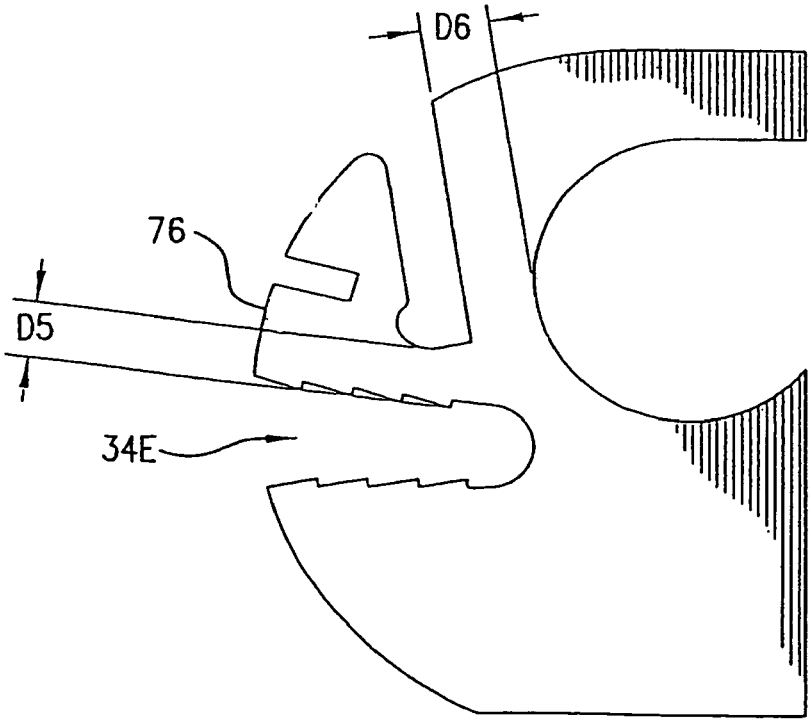
FIG. 12 is a side view of an alternative embodiment of the clip of FIGS. 10 and 11.

FIGS. 10-12 illustrate a further embodiment of the invention which also includes locking levers 76 and 92 (and corresponding hinges 77B and 93B), but it is dimensioned differently to achieve a preferred locking action of the locking levers 76 and 92 against, respectively, the horizontal portion 28 and a lip 30 of a conventional gutter of FIG. 1 or a vertically walled gutter 54 of FIG. 4. In that embodiment, the preferred thickness of the hinge 77B (distance D5), corresponds to D3 in FIG. 9, but it is only about 3/32 inch (0.09 inch or about 2.4 mm) and can be as little as about 1/16 inch (0.06 inch or about 1.6 mm). The slot-to-throat distance D6 is the shortest distance between the throat 42 and the wall 114 of the slot 74 and is preferably about 15/128 inch (0.11 inch—about 2.8 mm).

The slot-to-throat distance D6 and hinge thickness D5 can vary from those that are preferred, but the ratio of D6 to D5 should be no less than about 1.1 and no more than about 2.0, but preferably about 1.5.

The hinge thickness 93B (distance D7 in FIG. 11) is preferably about 11/128 inch (about 0.087 inch or about 2.2 mm). The curl-to-gutter (stop-to-throat) distance D8 is preferably about 19/128 inch (about 0.144 inch or 3.7 mm). Again, however, it is important that the ratio of D8/D7 be no less than about 1.1 and preferably about 1.5, but a D8/D7 ratio of about 2.0 is also acceptable.

If desired, the upper corner of the locking lever 76 can be rounded as shown, for example, in FIG. 11.

The FIG. 12 embodiment is, in all respects, the same as FIG. 11, but it only includes the upper locking lever 74 for use with conventional gutters having horizontal portions 28 such as shown in FIG. 1; and the ratios of the slot-to-curl distance (D6) to the hinge thickness (D5) remain the same. That is between about 1.1 and 2.0, but preferably about 1.5.

While the invention has been specifically shown and described with reference to preferred embodiments, it will be understood by those skilled in the art that various changes in form and detail may be made therein without departing from the spirit and scope of the invention.

The embodiments of the invention in which an exclusive property or privilege are claimed are defined as follows:

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosure of all applications, patents and publications, cited herein and of corresponding U.S. Provisional Application Ser. No. 60/453,952, filed Mar. 13, 2003, are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A gutter-cover system for spacing a wall of a gutter from a gutter cover comprising:

a cover, said cover comprising a solid sheet having one longitudinal edge thereof formed into a curl and wherein the cover extends downwardly and outwardly from the lowermost edge of a roof so that said curl extends downwardly toward said gutter;

a gutter-cover clip having a substantially flat body portion of a given thickness (D); said body portion providing a first planar side, a second planar side, and an outer edge whereby the clip resides in a single plane; said body portion comprising a first throat portion having first and second jaws thereof and shaped so that said first throat portion is adapted to engage said curl of said cover, said curl of said cover selectively received by said first throat portion;

third and fourth jaws and a second throat located therebetween, said second throat being adapted to engage said wall of said gutter between said third and fourth jaws;

at least a first locking lever adjacent said third jaw and joined to said body portion by a hinge, said first locking lever being adapted to be bent at said hinge to bring said third jaw into a locking position against said gutter; and a bending slot in said body portion, said bending slot being located above said second throat so that said hinge is between said second throat and said bending slot, said hinge having a width (D3), whereby a force applied to said bending slot moves said locking lever about said hinge so that said third jaw is brought into locking engagement with said wall of said gutter.

2. The gutter-cover system of claim 1 wherein the width of said hinge (D3) is between about 1/16 inch and 7/64 inch.

3. The gutter-cover system of claim 2 wherein the width (D3) is preferably about 3/32 inch.

4. The gutter-cover system of claim 2 wherein the ratio of the hinge width (D3) to the thickness (D) of said body portion is about 0.25 and 1.2.

5. The gutter-cover system of claim 4 wherein the ratio of hinge width (D3) to the thickness (D) is about 0.94.

6. The gutter-cover system of claim 1 including a locking slot for accommodating a locking-unlocking tool for selectively pivoting said locking lever about said hinge and into a lock or unlocked position.

7. The gutter-cover system of claim 1 including a recess in said third jaw for accommodating an unlocking tool for pivoting said locking lever about said hinge to move said third jaw out of engagement with said gutter.

8. The gutter-cover system of claim 1 wherein at least one of said jaws is serrated.

9. The gutter-cover system of claim 1 including fifth and sixth jaws and a second locking lever adjacent said fifth jaw and joined to said body portion by a second hinge, said second locking lever being adapted to be bent at said second hinge to bring said fifth jaw into a locking position against a vertical wall of said gutter.

10. The gutter-cover system of claim 9 including a third throat portion between said fifth and sixth jaws and wherein a distance (D4) is the shortest line between said first throat and said third throat is between about 1/8 and 7/16 inch.

11. The gutter-cover system of claim 10 wherein the distance (D4) is about 5/16 inch.

12. The gutter-cover system of claim 1 wherein at least one of said third or fourth jaws is serrated.

13. The gutter-cover system of claim 1 including a third throat and wherein a second hinge having a width (D2) is formed between said third throat and said third jaw, said second hinge and wherein the width (D2) of said second hinge is between about 1/16 inch and 5/32 inch.

14. The gutter-cover system of claim 13 wherein the width (D2) is about 3/32 inch.

15. The gutter-cover system of claim 13 wherein the ratio of the hinge-width (D2) to the thickness (D) of said body portion is between about 0.25 and 1.2.

16. The gutter-cover system of claim 15 wherein the ratio of the width (D2) to the thickness (D) is about 0.94.

17. The gutter-cover system of claim 1 wherein said body portion is comprised of a bendable metal.

18. The gutter-cover system of claim 1 wherein the deepest part of said first throat and the deepest part of said second throat lie essentially in a common plane.

19. A gutter-cover system for spacing a wall of a gutter from a gutter cover comprising:

a cover, said cover comprising a solid sheet having one longitudinal edge thereof formed into a curl and wherein the cover extends downwardly and outwardly from the lowermost edge of a roof so that said curl extends downwardly toward said gutter, said gutter-cover clip having a substantially flat body portion of a given thickness (D); said body portion providing a first planar side, a second planar side, and an outer edge whereby the clip resides in a single plane; said body portion comprising a first throat portion having first and second jaws thereof and shaped so that said first throat portion is adapted to engage said curl of said cover, said curl of said cover selectively received by said first throat portion;

third and fourth jaws and a second throat located therebetween, said second throat being adapted to engage said wall of said gutter between said third and fourth jaws;

at least a first locking lever adjacent said third jaw and joined to said body portion by a first hinge, said first locking lever being adapted to be bent at said first hinge to bring said third jaw into a locking position against said gutter;

a bending slot in said body portion located above said second throat and wherein the ratio of the distance between said first throat and said bending slot to the thickness of said hinge is between about 1.1 and 2.0.

20. A gutter-cover clip for spacing a wall of a gutter from a gutter cover of the type in which a cover comprises a solid sheet has one longitudinal edge thereof formed into a curl and wherein the cover extends downwardly and outwardly from the lowermost edge of a roof so that said curl extends downwardly toward said gutter, said gutter-cover clip comprising:

a substantially flat body portion of a given thickness (D); said body portion providing a first planar side, a second planar side, and an outer edge whereby the clip resides in a single plane; said body portion comprising a first throat portion having first and second jaws thereof and shaped so that said first throat portion is adapted to engage said curl of said cover;

third and fourth jaws and a second throat located therebetween, said second throat being adapted to engage said wall of said gutter between said third and fourth jaws;

at least a first locking lever adjacent said third jaw and joined to said body portion by a hinge, said first locking lever being adapted to be bent at said hinge to bring said third jaw into a locking position against said gutter; and a bending slot in said body portion, said bending slot being located above said second throat so that said hinge is between said second throat and said bending slot, said hinge having a width (D3), whereby a force applied to said bending slot moves said locking lever about said hinge so that said third jaw is brought into locking engagement with said wall of said gutter.

21. A gutter-cover clip for spacing a wall of a gutter from a gutter cover of the type in which a cover comprises a solid sheet has one longitudinal edge thereof formed into a curl and wherein the cover extends downwardly and outwardly from the lowermost edge of a roof so that said curl extends downwardly toward said gutter, said gutter-cover clip comprising:

a substantially flat body portion of a given thickness (D); said body portion providing a first planar side, a second planar side, and an outer edge whereby the clip resides in a single plane; said body portion comprising a first throat portion having first and second jaws thereof and shaped so that said first throat portion is adapted to engage said curl of said cover;

third and fourth jaws and a second throat located therebetween, said second throat being adapted to engage said wall of said gutter between said third and fourth jaws;

at least a first locking lever adjacent said third jaw and joined to said body portion by a first hinge, said first locking lever being adapted to be bent at said first hinge to bring said third jaw into a locking position against said gutter;

a bending slot in said body portion located above said second throat and wherein the ratio of the distance between said first throat and said bending slot to the thickness of said hinge is between about 1.1 and 2.0;

fifth and sixth jaws and a third throat located therebetween, said third throat being adapted to engage a vertical wall of said gutter between said fifth and sixth jaws; and a second locking lever formed between said fourth and fifth jaws and joined to said body portion by a second hinge, said second locking lever being adapted to be rotated so that said vertical wall of said gutter is engaged between said fifth and sixth jaws.

22. The gutter-cover system of claim 19 wherein said ratio of the distance between said first throat and said bending slot to the thickness of said hinge is about 1.5.

23. The gutter-cover system of claim 19 wherein the ratio of a hinge width (D2) to the thickness (D) of the body portion is between 0.25 and 1.2.

24. The gutter-cover system of claim 23 wherein the ratio of the width of said first hinge to the thickness (D) is about 0.94.

25. The gutter-cover system of claim 19 including fifth and sixth jaws and a third throat located therebetween, said third throat being adapted to engage a vertical wall of said gutter between said fifth and sixth jaws;

a second locking lever formed between said fourth and fifth jaws and joined to said body portion by a second hinge, said second locking lever being adapted to be rotated so that said vertical wall of said gutter is engaged between said fifth and sixth jaws.

26. The gutter-cover system of claim 25 wherein a width (D7) of said second hinge is about $^{11}/_{128}$ inch.

27. The gutter-cover system of claim 25 wherein the ratio of a distance (D8) between the first and second throats to a width (D7) of said second hinge is between about 1.1 and 2.0.

28. The gutter-cover system of claim 27 wherein said ratio of the distance (D8) to the width (D7) is about 1.5.

29. The gutter-cover system of claim 19 wherein the width of said first hinge is between about $^{1}/_{16}$ and $^{3}/_{32}$ inch.

30. The gutter-cover system of claim 19 wherein the bending slot in the body portion above said second throat is located so that said first hinge is between said second throat and said bending slot and wherein a width (D6) is the shortest distance between said first throat and said bending slot and such that said third jaw clamps onto said wall of said gutter upon insertion and rotation of a bending tool in said bending slot.

31. The gutter-cover system of claim 30 wherein the width (D6) is about $^{15}/_{128}$ inch.

32. The gutter-cover system of claim 30 wherein the ratio of the width (D6) to a width (D5) is between about 1.1 and 2.0.

33. The gutter-cover system of claim 32 wherein the ratio of the width (D6) to the width (D5) is about 1.5.

34. The gutter-cover system of claim 19 wherein a distance (D8) between said first throat and said second throat is preferably about $^{19}/_{128}$ inch.

35. A gutter-cover system for spacing a vertical wall of a gutter from a gutter cover comprising:

a cover, said cover comprising a solid sheet having one longitudinal edge thereof formed into a curl and wherein the cover extends downwardly and outwardly from the lowermost edge of a roof so that said curl extends downwardly toward said gutter;

a gutter-cover clip having a substantially flat body portion of a given thickness (D); said body portion providing a first planar side, a second planar side, and an outer edge whereby the clip resides in a single plane; said body portion comprising a first throat portion having first and second jaws thereof and shaped so that said first throat portion is adapted to engage said curl of said cover, said curl of said cover selectively received by said first throat portion;

third and fourth jaws and a second throat located therebetween, said second throat being adapted to engage said vertical wail of said gutter between said third and fourth jaws wherein said third and fourth jaws are essentially parallel to said vertical wall of said gutter;

at least a first locking lever adjacent said third jaw and joined to said body portion by a hinge, said first locking lever being adapted to be bent at said hinge to bring said third jaw into a locking position against said gutter; and a bending slot in said body portion located adjacent said third jaw so that said hinge is between said third jaw and said bending slot whereby a force applied to said bending slot moves said locking lever about said hinge so that said third jaw is brought into locking engagement with said vertical wall of said gutter.

* * * * *